US007934802B2

(12) United States Patent
Nakata et al.

(10) Patent No.: US 7,934,802 B2
(45) Date of Patent: May 3, 2011

(54) LIGHT IRRADIATION DEVICE AND INKJET PRINTER

(75) Inventors: Shigenori Nakata, Yokohama (JP); Katsuya Watanabe, Yokohama (JP)

(73) Assignee: Ushiodenki Kabushiki Kaisha, Tokyo (JP)

( * ) Notice: Subject to any disclaimer, the term of this patent is extended or adjusted under 35 U.S.C. 154(b) by 711 days.

(21) Appl. No.: 11/861,897

(22) Filed: Sep. 26, 2007

(65) Prior Publication Data

US 2008/0074887 A1 Mar. 27, 2008

(30) Foreign Application Priority Data

Sep. 27, 2006 (JP) ..... 2006-261764

(51) Int. Cl.
*B41J 2/14* (2006.01)
*B41J 2/16* (2006.01)

(52) U.S. Cl. ..... 347/51; 347/102

(58) Field of Classification Search ..... 347/51, 347/52, 101, 102
See application file for complete search history.

(56) References Cited

U.S. PATENT DOCUMENTS

| | | | | |
|---|---|---|---|---|
| 6,686,677 | B2 * | 2/2004 | Kondo et al. | 313/113 |
| 6,739,716 | B2 * | 5/2004 | Richards | 347/102 |
| 6,803,991 | B2 | 10/2004 | Mori | |
| 2005/0168509 | A1 | 8/2005 | Yokoyama | |

FOREIGN PATENT DOCUMENTS

| | | | |
|---|---|---|---|
| EP | 0 534 598 | A1 | 3/1993 |
| EP | 0 783 116 | A1 | 7/1997 |
| JP | 2005-103852 | A | 4/2005 |
| JP | 2005-305742 | A | 11/2005 |

* cited by examiner

*Primary Examiner* — Juanita D Stephens
(74) *Attorney, Agent, or Firm* — Roberts Mlotkowski Safran & Cole, P.C.; David S. Safran

(57) ABSTRACT

A light irradiation device that is capable of good irradiance uniformity in the lengthwise direction and that is applicable to an inkjet printer. A light-emitting portion of a short-arc type discharge lamp is positioned at the first focal point of a reflector that has a reflecting surface in the shape of an ellipsoid of revolution, and the light from the discharge lamp is reflected by the reflector and is focused at the second focal point; after which the light is incident on multiple, columnar rod lenses 14. Of the light that is incident on the rod lenses, the light along the axial direction is focused at the second focal point of an elliptical reflector without being affected by the rod lenses, and the light along the direction perpendicular to the axial direction is focused by the rod lenses and then spreads and irradiates the light irradiation surface.

9 Claims, 11 Drawing Sheets

LIGHT IRRADIATION DEVICE AND INKJET PRINTER

BACKGROUND OF THE INVENTION

1. Field of the Invention

This invention concerns a light irradiation device that uses a short-arc lamp to form a linear, long thin light irradiation region and an inkjet printer. In particular, the invention relates to a light irradiation device that forms a linear light irradiation region having a uniform irradiance on the article to be irradiated, and an inkjet printer, in which this light irradiation device is mounted, that records images or circuits and other patterns on a substrate by ejecting a light-curable liquid material onto the substrate.

2. Description of Related Art

Because it is possible to produce images more conveniently and cheaply than the gravure method, in recent years, the inkjet printing method has been adopted in a variety of printing fields including specialty printing, such as photographs, printing of various kinds, marking, and color filters.

In the inkjet printing method, it is possible to obtain high graphic quality by combining inkjet printers of the inkjet printing method that eject and control fine dots, inks with improved color reproduction, durability, and ejection properties, and specialty papers with greatly improved ink absorption, color development properties, and surface gloss.

These inkjet printers can be classified by the type of ink, but among them there is a light-cure inkjet method that uses light-curable inks that are cured by irradiation with ultraviolet and other light. The light-cure inkjet method is a relatively low-odor process and is noted for quick drying even with non-specialty papers and the ability to print even on recording media that do not absorb ink.

With inkjet printers of this light-cure inkjet type (called "inkjet printers" hereafter), a light source that irradiates light is mounted on the carriage along with the inkjet head that ejects ink in the form of small droplets onto the substrate; the carriage is moved with the light source lighting the substrate, and the ink is cured by irradiation with the light immediately after it impacts the substrate (see, for example, JP Pre-grant Patent Report Nos. 2005-246955 (corresponding to U.S. Patent Publication No. 2005/0168509), 2005-103852, & 2005-305742 and the article "Trends of UV Inkjet Printing," Noguchi Hiromichi, Orikasa Teruo, Bulletin of the Japanese Society of Printing Science and Technology, Vol. 40, No. 3, p. 32 (2003).

Now, there have been attempts in recent years to use inkjet printers not only for printing of images as mentioned above, but also for forming electronic circuit patterns. In this case, the liquid material that is from the inkjet head is a material for making circuit boards, such as a light-curable resist ink; the substrate on which printing (that is, pattern formation) is performed is, for example, a printed-circuit board.

Formation of circuit patterns by means of resist ink, like record printing of images, has used a dry and cure reaction by means of UV or other light and the material ejected from the inkjet head is different from resist or ink, but the configuration of the inkjet printer equipment is the same.

Equipment that records images on a substrate using light-curable ink is explained below as an example of an inkjet printer.

FIG. 10(*a*) is a perspective view showing the schematic structure of the head portion of an inkjet printer; and FIG. 10(*b*) is a cross section, cut along the vertical plane of the light beam of the lamp of the light irradiation device 6 or 7 shown in FIG. 10(*a*). Now, FIG. 10(*a*) is drawn so that the interior of the light irradiation device is visible in order to facilitate the explanation that follows.

An inkjet printer 1 has a bar-shaped guide rail 2, and a carriage 3 is supported on this guide rail 2. The carriage 3 is moved by a carriage drive mechanism (not shown) back and forth along the guide rail 2 above a substrate 5. This direction is called the X direction below.

On the carriage 3 is mounted an inkjet head 4 to which are attached nozzles (not shown) that eject ink of various colors for color printing. Light irradiation devices 6, 7 are attached on both sides, in the direction of movement on the carriage 3, of the inkjet head 4, and the light irradiation devices 6, 7 irradiate the ink, which is the liquid material ejected onto the substrate 5 from the nozzles of the inkjet head 4, with ultraviolet light.

Now, the portion that comprises the inkjet head 4 and the irradiation devices 6, 7 is called the head portion 1*a* below.

In FIG. 10(*a*), when printing is being performed on the substrate while the carriage 3 is moving forward in the X direction shown in that figure, the ink from the inkjet head 4 of the head portion 1*a* is cured by means of the light from the light irradiation device 6. Further, when printing is being performed on the substrate while the carriage 3 is moving backward in the X direction, the ink from the inkjet head 4 of the head portion 1*a* is cured by means of the light from the light irradiation device 7.

The light irradiation devices 6, 7 have box-shaped covers 8 in which there are openings 20 facing the substrate 5, and within the covers there are long-arc type discharge lamps 90 which are linear light sources that run in the direction perpendicular to the X direction of movement of the carriage 3 (hereafter, the Y direction). The length of the light emitting tubes of the lamps 90 is roughly equal to the length in the Y direction of the inkjet head 4.

High-pressure mercury lamps or metal halide, for example, are used as these long-arc type discharge lamps.

There is a tubular reflector 110 that reflects the light (ultraviolet light) emitted from the lamp 90 on the side of the lamp 90 opposite the opening 20. The cross section of the reflector 110 has an elliptical shape as shown in FIG. 10(*b*); the discharge lamp 90 is located at the first focal point of the ellipse and the light (ultraviolet light) emitted from the lamp 90 is focused in linear form at the second focal point of the reflector 110, but irradiation by direct-projection light from the lamp 90 is added to that.

The substrate 5 is located so that it passes through the second focal point position of the reflector 110 or its vicinity, and the ink that impacts the substrate 5 is irradiated by light focused by the reflector 110.

Recently there has come to be a desire that the light (ultraviolet light) that cures the ink have even stronger irradiance in inkjet printers as described above.

The ink must have low viscosity, to some extent, to be ejected smoothly from the nozzles of the inkjet head. For that reason, if the ink is not cured (photopolymerized) immediately after impacting the substrate, the shape of the dot of ink will change after impact and image quality is reduced. In order to conduct curing (photopolymerization) quickly, it is desirable to irradiate light with a high peak irradiance so the polymerization reaction goes forward at once.

To meet this demand, consideration has been given to making the polymerization reaction go forward quickly by means of increasing the peak irradiance of the irradiating light from the light irradiation device. For example, JP Pre-grant Patent Publication No. 2005-246955 and corresponding U.S. Patent Publication No. 2005/0168509, cited above, disclose that it is possible to lessen the degree that the speed of ink curing drops because of oxygen, or in other words, it is possible to prevent a decrease in image quality by speeding up the ink curing process; it also states that it is possible to form a light irradiation region of equal size to that produced by a long-arc type discharge lamp and that a microwave UV lamp is effective in yielding higher irradiance than a long-arc type discharge lamp. The peak irradiance of the microwave UV lamp mentioned in JP Pre-grant Patent Publication No. 2005-246955 and corresponding U.S. Patent Publication No. 2005/0168509 is in the range of 1000 to 1200 mW/cm$^2$.

Further, the JP Pre-grant Patent Publication 2005-103852, cited above, describes technology to locate lenses between multiple light source lamps, located on a plane, and the substrate, and to increase the peak irradiance irradiating the substrate by means of focusing light from the light source lamps to irradiate the substrate.

However, even when irradiating with light focused from light source lamps using optical elements such as lenses and mirrors, the peak irradiance yielded will be limited unless the radiance of the light source lamps themselves is increased; this is the case even when using the microwave UV lamps as described in JP Pre-grant Patent Publication No. 2005-246955 and corresponding U.S. Patent Publication No. 2005/0168509.

It is thought that there will be further demands to increase the peak irradiance of the light irradiating the substrate in the future; to satisfy these demands it will be necessary to further increase lamp radiance. However, the reality is that it is technically difficult to further increase the radiance of long-arc lamps, which have large light-emitting tubes, or microwave UV lamps.

Further, there are also the following problems in the inkjet printers described above. That is, in a conventional inkjet printer having the configuration shown in FIG. 10(*a*), for example, the discharge lamps 90 face the substrate 5 directly, through the openings 20.

Accordingly, the light from the discharge lamps 90 irradiates the substrate 5 directly, but the light emitted from the discharge lamps 90 includes light from the visible and infrared regions that is not needed for curing ultraviolet-cured inks, and thermal radiation from the arc tube of the discharge lamps 90, which reach high temperatures when the lamps are lit, is also incident on the substrate 5, so that the substrate 5 is heated by means of the light from the visible and infrared regions and the thermal radiation from the lamp seal portions.

Materials that are easily deformed by heat—paper, resin, or film, for example—are often used as the substrate 5, so if one simply uses lamps with higher power to increase the radiance, the effect on the substrate 5 of heat from light in the visible and infrared regions and from thermal radiation will be even greater, the temperature of the substrate will raise even higher, and this will be the source of degraded printing quality as such results in deformation.

One possibility for dealing with such problems is to place a reflecting mirror (also called a cold mirror), on which is formed a vapor deposition layer that reflects only light of the wavelengths for curing the ink and allows other wavelengths to pass through, between the discharge lamp and the substrate; because only the light reflected by this reflecting mirror irradiates the substrate, the effect of heat on the substrate is reduced.

However, putting such a reflecting mirror in place lengthens the optical path from the discharge lamp to the substrate by that much more; in the case of a long-arc type discharge lamp, for example, that makes it impossible to focus light in the lengthwise direction of the discharge lamp, and so the area irradiated by the light (the light irradiation region) is expanded, reducing the efficiency of light use and also making it impossible to obtain high enough irradiance in the light irradiation surface (the substrate surface).

As stated above, the reality is that it is difficult to increase the peak irradiance in the light irradiation surface beyond the conventional level and devise improvement of the ink curing process in inkjet printers that use the light-cure inkjet method.

In order to solve such problems, it is proposed in commonly owned, co-pending U.S. patent application Ser. No. 11/738,160, to use a light irradiation device having, as the light source lamp, a short-arc type discharge lamp that has greater radiance than long-arc type discharge lamps, and focusing the light from the lamps to extend the light in a line. FIG. 11 shows an example of the configuration of the light irradiation device proposed in that co-pending U.S. patent application.

The light from a short-arc type discharge lamp 9 is first reflected by a reflector 111 that has a reflective surface that is a paraboloid of revolution placed to surround the lamp 9. Next, the light that has been reflected by the reflector 111 is reflected by a mirror 112 that has a cylindrical reflecting surface of which a cross section is parabolic.

The light from the lamp 9 is reflected as collimated light by the reflector 111 that has a reflecting surface that is a paraboloid of revolution. When the collimated light is reflected by the mirror 112 that has a reflecting surface of which a cross section is parabolic, the light is focused on the light irradiation surface 13 in a linear direction perpendicular to the plane of the paper in FIG. 11.

In the light irradiation device described above, however, no particular consideration was given to the uniformity of irradiance in the lengthwise direction of the linearly focused light. For that reason, it is thought, the irradiance distribution in the light irradiation region has high irradiance in the center and declining irradiance towards the edges. In order to process uniformly across the full irradiation region, it is necessary to form a light irradiation region with good uniformity of irradiance. Poor uniformity of irradiance results in the problem that uniform processing across the full irradiation region is not possible.

SUMMARY OF THE INVENTION

The present invention was made on the basis of the situation described above, and has as a primary object to provide a light irradiation device that irradiates linearly focused light, that can yield high peak irradiance, and that has good uniformity of irradiance in the lengthwise direction of linearly focused light.

This invention has the further object of providing an inkjet printer that includes the light irradiation device described above, that can cure ink and other liquid materials with high efficiency, that consequently can reliably form patterns, such as images and circuits, with high graphic quality, and that has a low level of thermal effects on the substrate.

The problems described above are solved by this invention as follows.

(1) The light irradiation device has a short-arc type discharge lamp that comprises a pair of electrodes placed facing each other within a discharge vessel and an optical element that focuses light from that lamp, in which there are multiple rod lenses arranged in parallel in a plane perpendicular to the optical axis of the light emitted from the optical element.

The rod lenses are bar-shaped lenses of which the cross section is circular or nearly circular (columnar lenses), and function such that light spreads only in directions perpendicular to the axial direction, that is, a straight line perpendicular to that cross section that runs through the approximate center of the cross section (this straight line is called the rod lens axis hereafter).

In this invention, multiple rod lenses are placed with their axial directions parallel in a plane perpendicular to the optical axis of the light that is emitted from the optical element described above, and so the light is spread only in directions perpendicular to the axes of the rod lenses; the spread light that emerges from the multiple rod lenses overlaps on the light irradiation surface so the beams of stronger and weaker irradiance supplement each other and the irradiance distribution on the light irradiation region is made uniform.

On the other hand, the light does not spread in the axial direction of the rod lenses, and the light incident on the rod lenses is emitted from the rod lenses unchanged, and so the light in the axial direction of the rod lenses is focused by the optical element described above.

Therefore, the light from the rod lenses is linearly focused in the light irradiation surface in directions that are perpendicular to the axes of the rod lenses, and the irradiance is uniform in the lengthwise direction of the linearly focused light.

(2) The optical element of (1) above has a reflector with a reflecting surface that is an ellipsoid of revolution that reflects the light from the discharge lamp, placed so that it surrounds the discharge lamp.

(3) The optical element of (1) above has a reflector with a reflecting surface that is a paraboloid of revolution that reflects the light from the discharge lamp, placed so that it surrounds the discharge lamp, and a convex lens that focuses the light from the reflector.

(4) Multiple light irradiation devices having the configuration described in any of (1) through (3) above are lined up with at least one part (end) of the regions irradiated by adjoining irradiation devices overlapping in a direction perpendicular to the direction in which the light irradiations devices are lined up.

(5) In the light irradiation device described in (1) through (4) above there is also a reflecting mirror on the light irradiation side of the multiple rod lenses that reflects light that spreads in a direction perpendicular to the axial direction of the rod lenses.

(6) The inkjet printer, having a head portion in which there is an inkjet head that ejects a light-curable liquid material onto a substrate and a light irradiation device that irradiates light to cure the liquid material that is ejected onto and impacts the substrate, and forming a pattern by curing the liquid material by means of ejecting the liquid material from the inkjet head while there is relative movement between the head portion and the substrate and irradiating the liquid material that has impacted the substrate with light from the light irradiation device, uses as its light irradiation device a light irradiation device as described in any of (1) through (5) above.

The following effects can be obtained with this invention:

(1) An optical element that focuses light from the discharge lamp is installed, and multiple rod lenses are placed parallel in a plane perpendicular to the optical axis of the light emitted from the optical element, and so the light focused by that optical element passes through the multiple rod lenses, by which it emerges spread only in directions perpendicular to the axial direction of the rod lenses; it does not spread in the axial direction of the rod lenses. For this reason, it is possible to focus light in a line on the light irradiation surface; further, the light beams that spread in directions perpendicular to the axial direction of the rod lenses overlaps on the light irradiation surface, and beams of stronger and weaker irradiance supplement each other.

Accordingly, it is possible to obtain a linearly focused light irradiation region with a uniform irradiance distribution with a device of relatively simple constitution.

Further, short-arc type discharge lamps of high brilliance are used as the discharge lamps, and so it is possible to obtain high peak irradiance in the light irradiation surface, and to provide light irradiation devices that are smaller and lighter than devices using conventional long-arc discharge lamps.

(2) The structure is such that the light from the light source lamps is reflected by reflectors, and only the light reflected by the reflectors is emitted, and so in the event that ultraviolet light, for example, is to be reflected, it is possible, by using a multi-layer vapor deposition mirror that reflects only ultraviolet light as the reflector, to reduce the effect of heat on the article being irradiated slightly, without direct incidence on the article being irradiated of light in the visible and infrared regions that is emitted from the discharge lamps or of thermal radiation when the discharge lamps are lit.

(3) By lining up multiple light irradiation devices, it is possible to obtain a stronger light irradiation region than if a single light irradiation device is used. Also, the peripheral region that has weaker irradiance than the central region has irradiance added by the mutual overlap, and has irradiance that is equal to that of the central region. It is possible, consequently, to set a larger effective region that has high enough irradiance in the light irradiation region, and a light irradiation region of a size suited to the purpose can be obtained reliably.

(4) Because reflecting mirrors that reflect the light spreading in directions perpendicular to the axial direction of the rod lenses are installed on the light-emission side of the multiple rod lenses in a parallel arrangement, it is possible to regulate the length of the light irradiation region, and it is also possible to supplement the irradiance of the low irradiance peripheral areas (ends).

(5) By using the light irradiation devices of this invention as the light irradiation devices of an inkjet printer, it is possible to irradiate light with a high peak irradiance from the discharge lamps onto an ink or other light-curable liquid material that has impacted the substrate, quickly cure (photopolymerize) the ink immediately after it has impacted the substrate, and thus, shorten the time required for curing.

Consequently, it is possible to prevent changes in the dot shape, and to reliably form high-quality patterns such as images and circuits.

Particularly, when an ultraviolet light-curable ink is used, moreover, the light that irradiates the substrate, the structure is one in which the light that irradiates the substrate is light that is emitted from the discharge lamps and reflected by the reflector, and so by means of a reflector that is a multi-layer vapor deposition mirror that only reflects ultraviolet light, none of the infrared and visible light that is included in the light emitted from the discharge lamps, but is not needed for curing the ink, nor the thermal radiation from the arc tube of the lamps when the discharge lamp is lit, is directly incident on the substrate. Consequently, it is possible to considerably reduce the effect of heat on the substrate, and to prevent deformation of the substrate.

Further, the light irradiation device of this invention can be made smaller and lighter that those with long-arc type discharge lamps, and so it is possible to make the inkjet printer as a whole lighter and also to speed up printing speed or pattern formation by increasing the efficiency of the ink curing process.

DETAILED DESCRIPTION OF THE INVENTION

First Embodiment

Figures 1A, 1B:
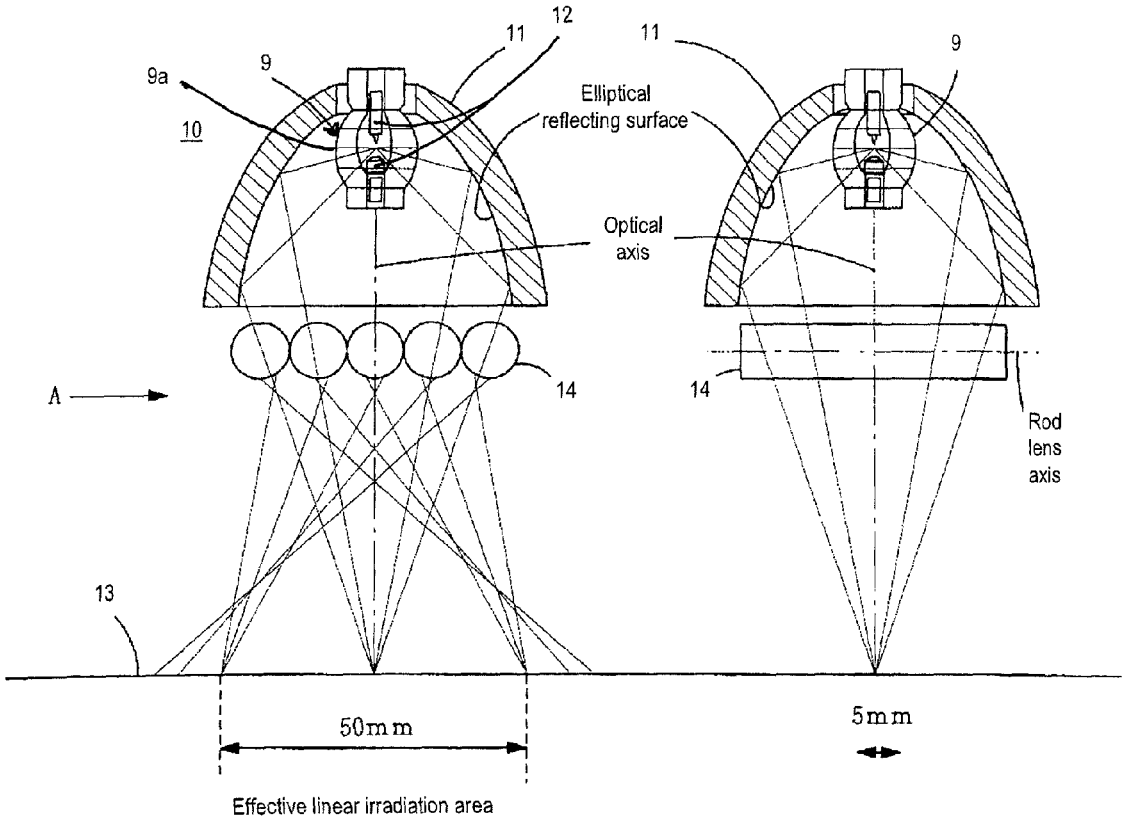
FIGS. 1(*a*) & 1(*b*) are diagrams showing the configuration of the light irradiation device of a first embodiment of this invention.

FIGS. 1(*a*) & 1(*b*) are diagrams showing the configuration of the light irradiation device of a first embodiment of this invention. FIG. 1(*a*) is a diagram as seen from the radial direction of the rod lenses; FIG. 1(*b*) is a diagram viewed in the direction A in FIG. 1(*a*). This embodiment shows the case of a reflector with a reflective surface that is an ellipsoid of revolution used as the optical element that focuses the light from the lamp.

In FIG. 1, the short-arc type discharge lamp 9 that constitutes the light source 10 of the light irradiation device is, for example, an ultra-high-pressure mercury lamp that emits ultraviolet light having a wavelength of 300 to 450 nm with good efficiency. Sealed in the discharge vessel 9*a* are a pair of electrodes 12 that face across a discharge gap of 0.5 to 20.mm, for example, specified volumes of mercury, which is the light emitting substance, a rare gas buffer gas to assist startup, and a halogen. The volume of mercury here is, for example, 0.08 to 0.30 mg/mm$^3$.

This discharge lamp 9 has the straight line connecting the pair of electrodes on an extension of the optical axis of the reflector 11. The reflector 11 has a reflective surface that is an ellipsoid of revolution centered on that beam axis, and the light-emitting part of the discharge lamp 9 (the spot of the arc, for example) is positioned at the first focal point of the reflector that has a reflective surface that is an ellipsoid of revolution.

Light from the short-arc type discharge lamp 9 is reflected by the reflector 11 that surrounds the lamp 9, and is emitted from the reflector 11 so that it is focused on the second focal point of the reflector 11.

The discharge lamp 9 here has the straight line connecting the pair of electrodes on an extension of the optical axis of the reflector 1, and the electrodes are placed in the part of the discharge lamp 9 that faces the opening of the reflector 11. For this reason, the light emitted from the discharge lamp 9 does not directly irradiate the light irradiation surface 13; almost all of the light emitted from the discharge lamp 9 emerges after reflection by the reflector 11.

Consequently, a cold mirror with multiple layers of vapor deposition that functions to let pass the infrared and visible components of light and thermal radiation from the lamp and to reflect only the ultraviolet light is used as the reflector to be described below, and so it is possible to prevent irradiation of the light irradiation surface by light in the infrared and visible regions included in the light emitted from the discharge lamps, and to prevent a temperature rise on the light irradiation surface.

Multiple columnar rod lenses are lined up parallel in contact in a plane perpendicular to the optical axis of light reflected by the reflector 11 and emitted on the light-emission side of the reflector 11. Now, the plane in which the rod lenses are located need not be strictly perpendicular to the beam axis. An inclination of 5° to 10° is no problem if it is within a range where there is no great effect on the irradiance distribution.

The light reflected by the reflector 11 becomes light focused at the second focal point of the reflector 11, and is incident on the rod lenses 14.

The rod lenses 14 have the function of spreading light, after it has been condensed, in directions perpendicular to their axial direction. They do not have that power, however, with respect to incident light in the axial direction.

Consequently, of the light incident on the rod lenses 14, the light along the axial direction is unaffected by the rod lenses, as shown in FIG. 1(*b*), and is focused at the second focal point of the elliptical reflector.

Of the light incident on the rod lenses 14, the light along directions perpendicular to the axial direction, on the other hand, is spread by the rod lenses 14 after it has been focused, and irradiates the light irradiation surface.

For that reason, the light obtained on the light irradiation surface is linearly focused, and extends in the direction perpendicular to the axial direction of the rod lenses 14.

The spreading light emitted from each rod lens 14 here has a irradiance distribution with high irradiance in its center. Because there are multiple parallel rod lenses 14 in the same plane, the light having a irradiance distribution with high irradiance in the center emitted from each rod lens 14 has irradiance peak positions that diverge and overlap on the light irradiation surface. Accordingly, the irradiance distribution of the light irradiation region is uniform except at the ends of the region.

Figure 2A:
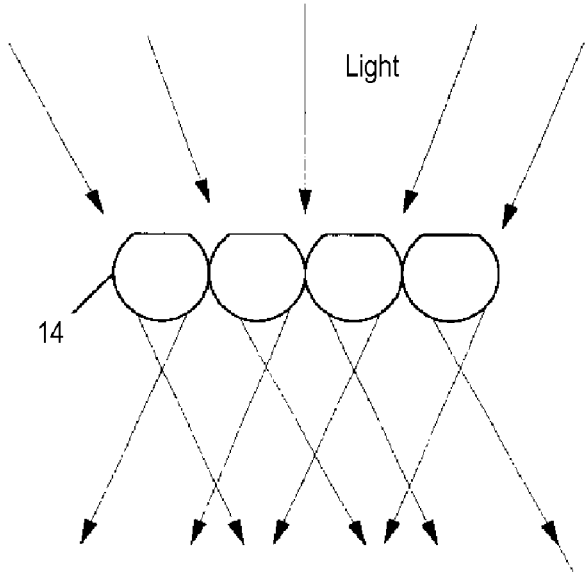
FIGS. 2(*a*)-2(*c*) are diagrams showing rod lenses of the FIG. 1 embodiment in cross section.
Figure 2B:
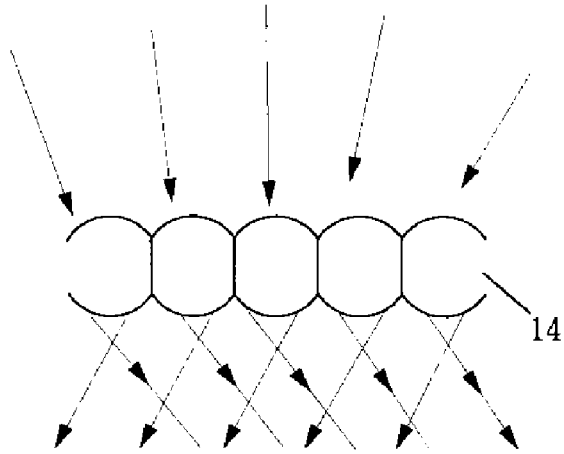
Figure 2C:
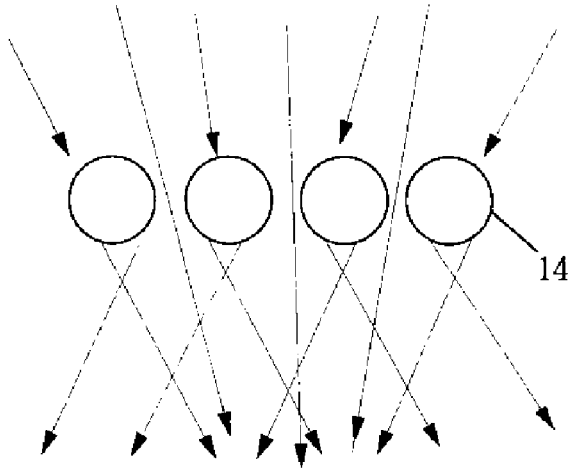

Now, the shape of the rod lenses need not be strictly cylindrical. It is possible to cut away, as shown in FIG. 2(*a*), the face where the incident light strikes or a part of the face where the incident light strikes in order to reduce the spacing of placement of the rod lenses 14. The more that is cut away, however, the weaker the power to spread light will be, and so the light beam overlap effect will be reduced.

Further, it is possible to cut away a portion of the sides, as shown in FIG. 2(*b*) to facilitate placing the rod lenses parallel and in contact, and it is possible to have the multiple rod lenses molded as a single unit. The key point is the action of spreading the incident light and overlapping the beams on the light irradiation surface; any shape is acceptable as long as that occurs.

Further, it is possible to line the rod lenses up with small gaps between them, instead of being in strict contact, as shown in FIG. 2(*c*). The light emitted from the reflector 11 that passes through these gaps passes through unrefracted. However, this is no problem if the amount of that light does not greatly impede the effect of unifying irradiance by means of overlap of the light spread by the multiple rod lenses.

A configuration like that in FIG. 2(*c*) can reduce the number of rod lenses used and work to cut costs.

The size and number of the rod lenses and the dimensions of the gaps between them, if any, are designed appropriately on the basis of various demand conditions, such as the length of the irradiation region, irradiance, uniformity, and the weight of the light irradiation device.

Figure 5A:
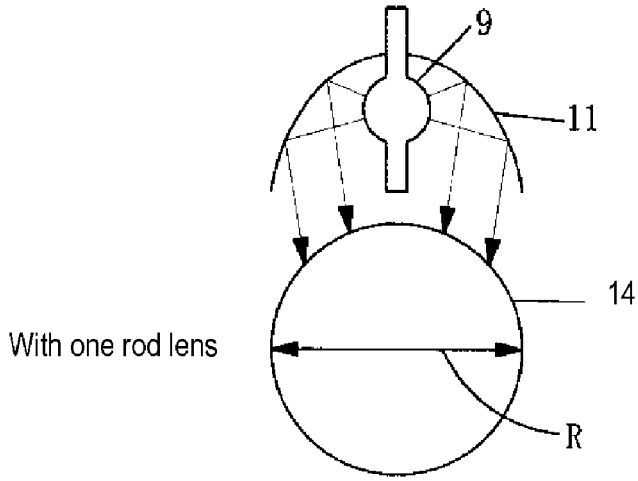
FIGS. 5(*a*)-5(*c*) are diagrams showing the placement of rod lenses with different numbers of rod lenses.
Figure 5B:
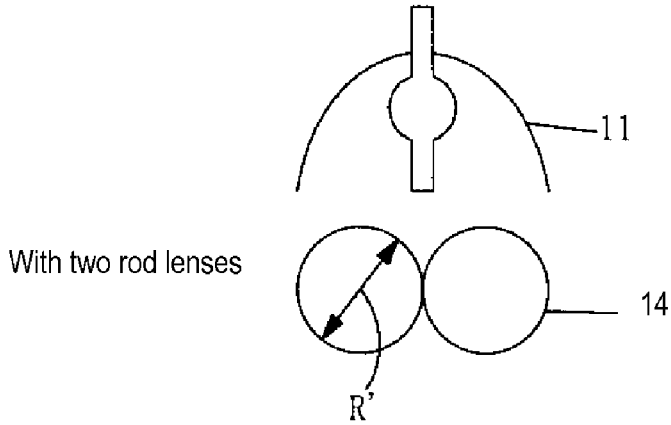
Figure 5C:
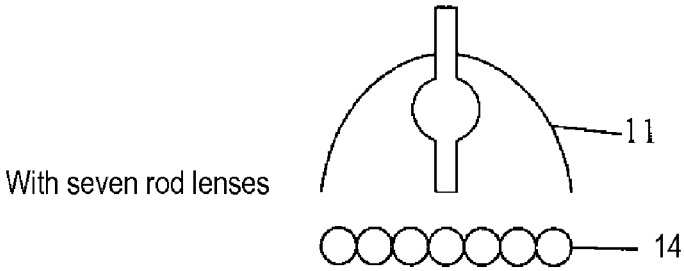

The example in FIG. 1 has an elliptical reflector with a first focal length F1 of 6 mm and a second focal length of 95 mm, and uses five rod lenses with a diameter (see R in FIG. 5(*a*) and R' in FIG. 5(*b*)) of 9.5 mm. The effective linear irradiation area on the light irradiation surface is 50 mm lengthwise and 5 mm in width.

Variation of First Embodiment

Figures 3A, 3B:
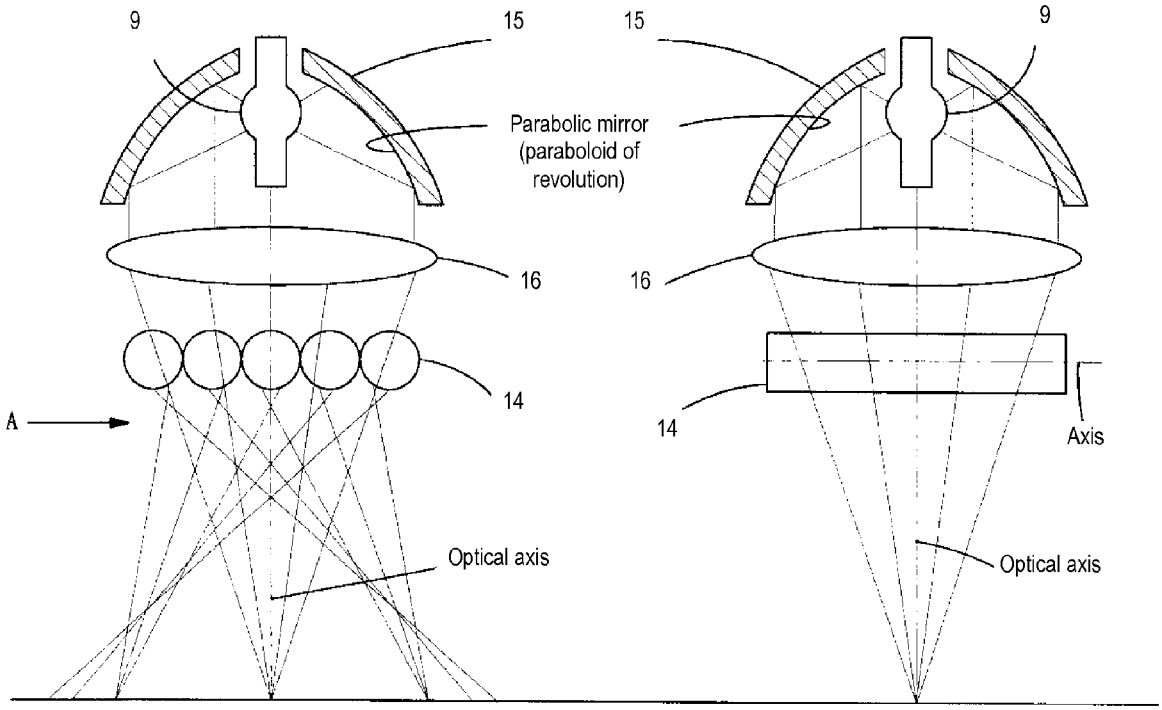
FIGS. 3(*a*) & 3(*b*) are diagrams showing the configuration of the light irradiation device of a modified version of the first embodiment of this invention.

Now, in this embodiment, a reflector with a reflective surface in the shape of an ellipsoid of revolution is used as the means of focusing the light emitted from the lamp, but it is possible to replace this, as shown in FIGS. 3(*a*) & 3(*b*), with a reflector 15 having a reflective surface in the shape of a paraboloid of revolution and a convex lens 16 on the light-emission side of the reflector 15. FIG. 3(*a*) is a diagram as seen from the radial direction of the rod lenses; FIG. 3(*b*) is a diagram as seen from the direction A in FIG. 3(*a*).

In FIG. 3, the reflector 15 is constituted by a parabolic mirror of which the reflective surface is a paraboloid of revolution centered on the beam axis, and the light-emitting portion (spot of the arc) of a short-arc type discharge lamp 9 is positioned at the its focal point.

The light from this discharge lamp 9 is reflected by the reflector 15 that surrounds the lamp 9, and gives collimated light. A convex lens 16 is installed on the light-emission side of the reflector 15, and on the light-emission side of the convex lens 16, multiple columnar rod lenses 14 are lined up parallel in contact in a plane perpendicular to the optical axis.

The light from the discharge lamp 9 is reflected by the reflector 15 as collimated light; that light is incident on the convex lens 16, and the light focused at the focal point of the convex lens 16 is incident on the rod lenses 14.

The rod lenses 14, as stated previously, act to spread the condensed light in directions perpendicular to their axial direction, but they have no power with respect to light that is incident along the axial direction, and so of the light that is incident on the rod lenses 14, the light along the axial direction is focused at the focal point of the convex lens 16, unaffected by the rod lens 14.

Of the light incident in the rod lenses 14, the light along directions perpendicular to the axial direction, on the other hand, is spread by the rod lenses 14 after it has been condensed, and irradiates the light irradiation surface.

For that reason, the light obtained on the light irradiation surface is linearly focused, and extends in the direction perpendicular to the axial direction of the rod lenses 14.

Experiment

Using the light irradiation device of the first embodiment shown in FIGS. 1(*a*) & 1(*b*), the irradiance distribution of the linearly focused light irradiation region on the light irradiation surface W was measured, changing the number of rod lenses.

Figure 4:
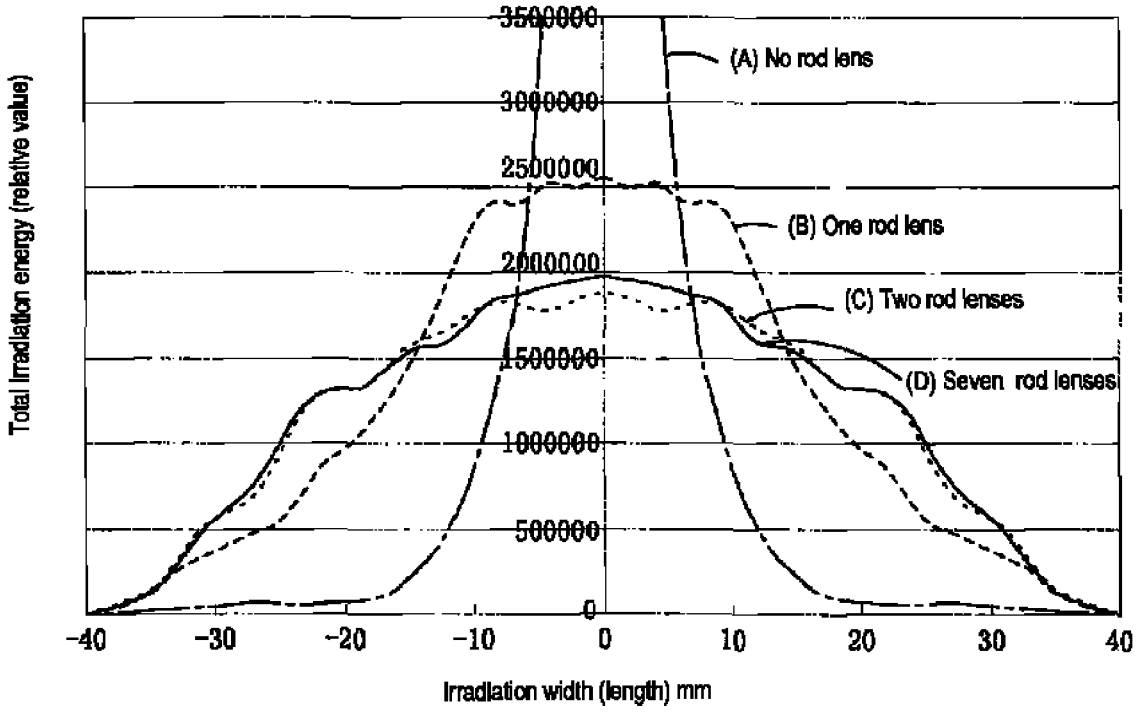
FIG. 4 is a graph of the results of measurements of the irradiance distribution in the light irradiation region with different numbers of rod lenses.

The results are shown in FIG. 4. The vertical axis is total radiant energy (relative value), and the horizontal axis is irradiation width (length) mm.

The four curves in FIG. 4 represent the number of rod lenses installed on the light emission side of the reflector, in cases of (A) no rod lens, (B) one rod lens, (C) two rod lenses, and (D) seven rod lenses.

Now, the rod lenses 14 on the light-emission side of the reflector 11 differ in size, as shown in FIGS. 5(*a*)-5(*c*), so that all the light reflected from the reflector 11 is incident on the rod lenses.

That is, in the case of one rod lens, the diameter R of the rod lens is equal to or slightly larger than the diameter of the light path (radiant flux) of the condensed light reflected by the reflector (FIG. 5(*a*)).

Further, in the case of two rod lenses, the diameter R' of the rod lens is equal to or slightly larger than the radius of the light path (radiant flux) of the condensed light reflected by the reflector (FIG. 5(*b*)). Similarly, in the case of seven rod lenses, the seven rod lenses together cover the entire light path (radiant flux) (FIG. 5(*c*)).

As shown in FIG. 4, when there is no rod lens, the irradiance distribution of the light irradiation region is focused, and so irradiance is extremely high in the center and quickly falls off toward the periphery. In the case of one rod lens, irradiance in the center is lower and the width of the region of uniform irradiance is broader than in the case of no rod lens, but that width is not adequate.

When there are two rod lenses, however, the effect of overlapping beams emitted from the rod lenses is manifest; the central irradiance is even lower, but a uniform irradiance distribution is available over a broader range. When there are seven rod lenses, the central irradiance is slightly lower, and the irradiance distribution is almost unchanged from the case of two rod lenses.

From the results of this experiment, it can be seen that if the number of rod lenses is two or greater, it is possible to bring about uniformity of the irradiance distribution on the light irradiation surface. Now, reducing the number of rod lenses increases the diameter of the rod lenses, and increases the weight relative to a larger number of rod lenses.

Second Embodiment

Figure 6:
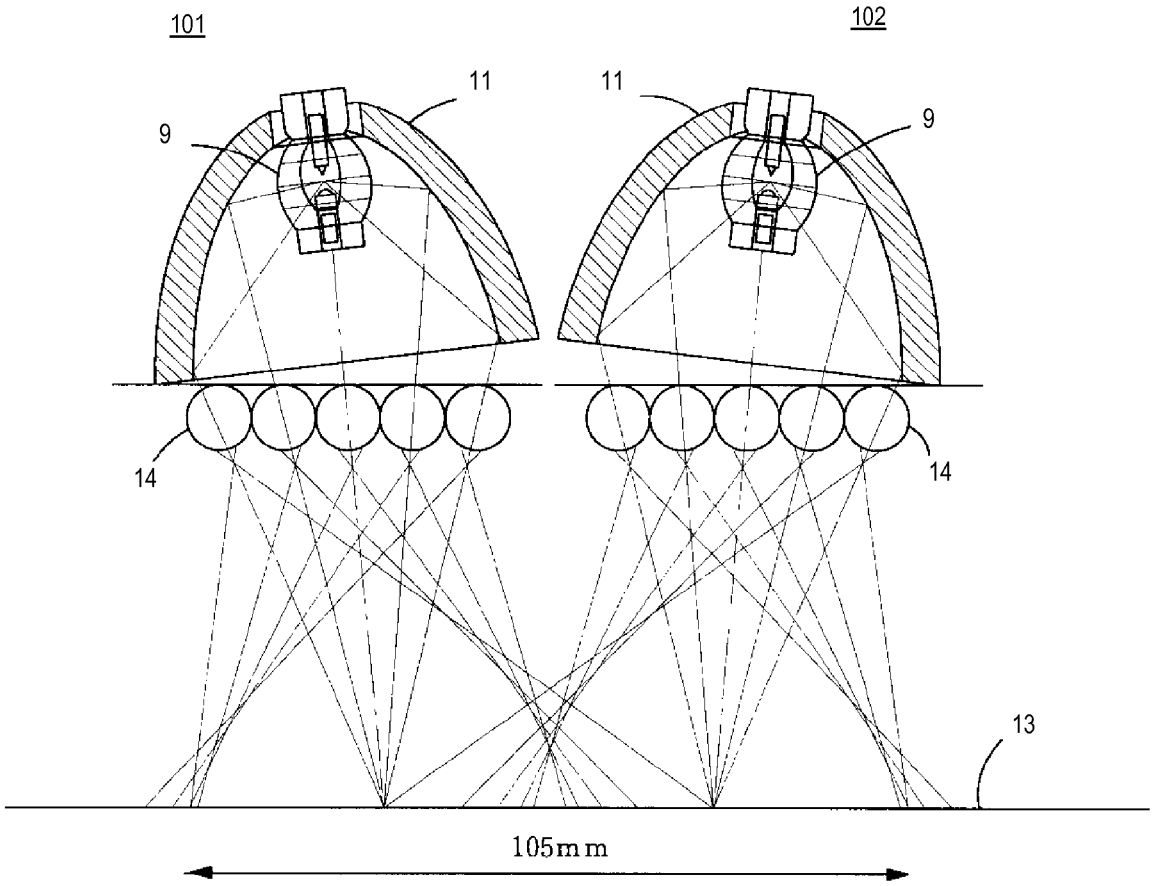
FIG. 6 is a diagram showing the configuration of the second embodiment of this invention.
Figure 7A:
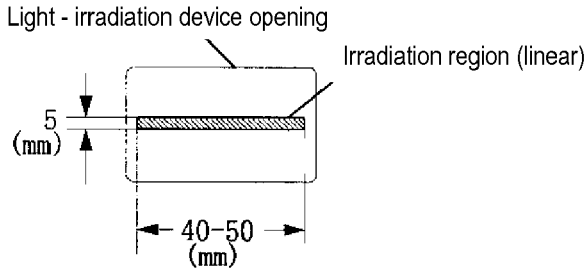
FIGS. 7(*a*)-7(*e*) are diagrams showing the shape of the light irradiation regions produced with the second embodiment of this invention.
Figure 7B:
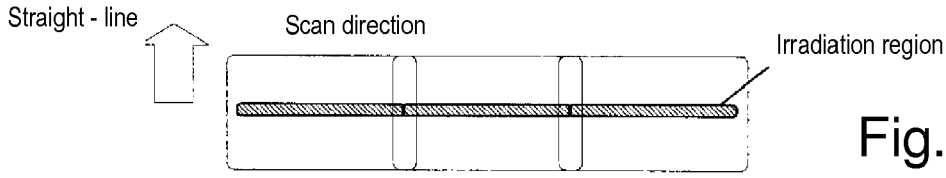
Figure 7C:
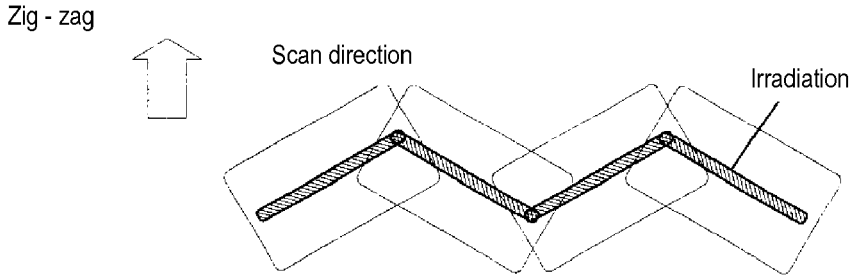
Figure 7D:
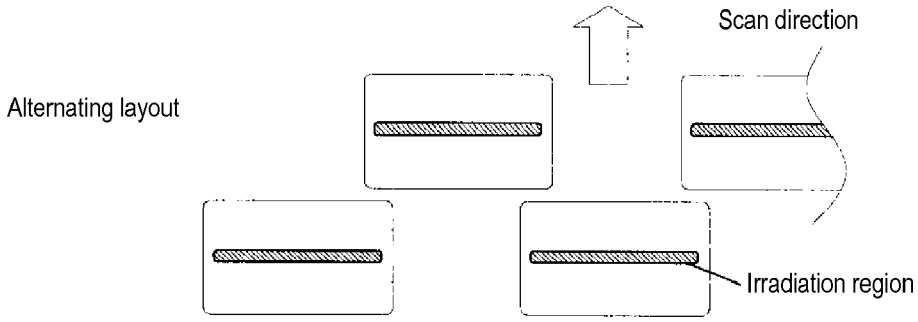
Figure 7E:
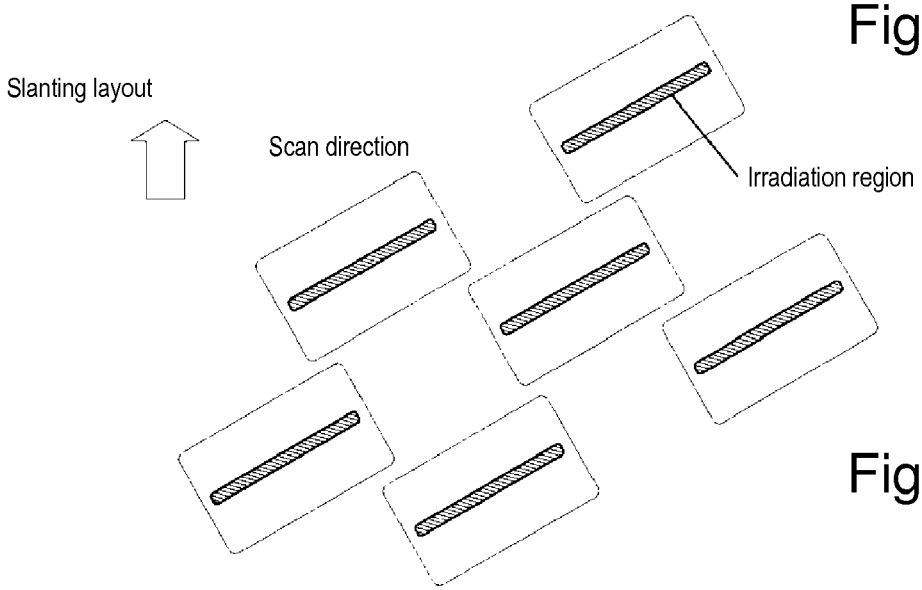

FIG. 6 is a diagram showing the second embodiment of this invention, which is constituted to obtain a longer linear light irradiation region. In FIG. 6, two of the light sources 10 shown in FIG. 1 are used in order to provide a long, linear light irradiation region, but it is also possible to use two of the light irradiation devices shown in FIG. 3.

In FIG. 6, the light sources 101, 102 have the same configuration as the light source 10 shown in FIG. 1: a straight line connecting the pair of electrodes on an extension of the optical axis of the reflector 11, and the reflector 11 has a reflective surface that is an ellipsoid of revolution centered on that optical axis, with the light-emitting part of the discharge lamp 9 (the spot of the arc, for example) positioned at the first focal point of the reflector 11 that has a reflective surface that is an ellipsoid of revolution.

In the light sources 101, 102, light from the discharge lamp 9 is reflected by the reflector 11 and is incident on the rod lenses 14; as stated previously, light focused in a line extending in the direction perpendicular to the axial direction of the rod lenses 14 on the light irradiation surface is obtained.

In the embodiment shown in FIG. 6, the light sources 101, 102 are placed so that the two light irradiation regions overlap at their edges; this means the light irradiation regions overlap and provide a linear light irradiation region that is longer than that when a single light source is used.

The actual placement here may require a gap between the two light sources 101, 102, or there may be reduced irradiance between the two light sources.

In such cases, it is possible to adjust by lengthening the distance between the rod lenses 14 and the light irradiation surface 13. Further, if the irradiation distance is long and peak irradiance is reduced, it is possible to adjust by tilting the optical axes of the lamps slightly. FIG. 6 is an example of such angling of the lamps; a uniform irradiance distribution is obtained by tilting the optical axes five degrees.

In FIG. 6, the use of two light sources is shown, but it is possible to use three or more light sources to obtain a longer light irradiation region.

Now, the shape of the light irradiation region formed by two or more light sources can be a straight line with at least portions of the light irradiation regions of adjoining light sources overlapping, but in the case of application to the inkjet printers mentioned above, there is no real need for the shape to be a straight line.

Examples of light irradiation region shapes are shown in FIGS. 7(*a*)-7(*e*). The arrows in this figure show the direction in which the light irradiation is scanned in the case of application to an inkjet printer.

FIG. 7(*a*) shows the shape of the light irradiation region when a single light source is used. FIG. 7(*b*) shows the light irradiation regions arranged in a straight line, FIG. 7(*c*) shows the light irradiation regions arranged in a zig-zag shape, FIG. 7(*d*) shows the light irradiation regions arranged staggered alternately, and FIG. 7(*e*) shows the light irradiation regions arranged obliquely.

In FIGS. 7(*b*) & 7(*c*), there is a partial overlap of light irradiation regions, but a partial overlap of light irradiation regions is not really necessary. In FIGS. 7(*c*) & 7(*d*), at least parts of the light irradiation regions overlap with respect to the direction perpendicular to the light source layout (the scan direction of the figures).

The light irradiation regions formed by the light sources of this invention to extend in a line have lower irradiance at the ends of the region than in the center, but in this embodiment, the end regions with lower irradiance than the center regions overlap each other, and so the irradiance of the end regions is augmented and is the same as the irradiance of the center regions.

In the light-irradiated regions, therefore, it is possible to set a large effective region that has adequately high irradiance, and it is possible to reliably obtain a light irradiation region of a size suited to the purpose.

Third Embodiment

Figures 8A, 8B:
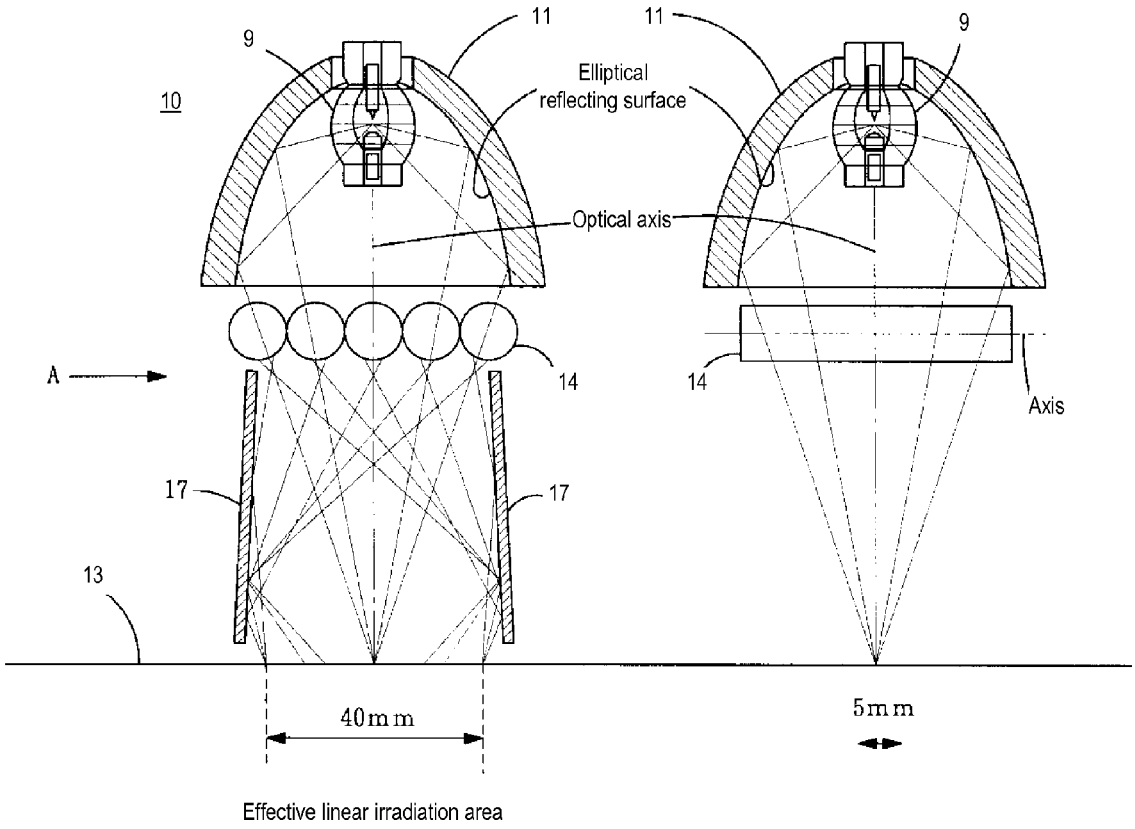
FIGS. 8(*a*) & 8(*b*) are diagrams showing the configuration of the third embodiment of this invention.

FIGS. 8(*a*)-8(*c*) are diagrams showing the third embodiment of the invention. This embodiment has reflecting mirrors 17 arranged parallel to the axial direction of the rod lenses 14 (lengthwise), i.e., on both sides of the rod lenses 14 in the embodiment shown in FIG. 1.

Of the light incident in the rod lenses 14, the light that is perpendicular to the axial direction (lengthwise) is spread by the rod lenses 14 after it is focused, as stated previously. For that reason, the irradiance peak of the light emitted from each rod lens 14 shifts and the light overlaps on the light irradiation surface; the irradiance distribution becomes uniform, but there is a irradiance distribution with higher irradiance at the center and lower irradiance at the edges.

In this embodiment, therefore, there are reflecting mirrors 17 on both sides of the light-emission side of multiple rod lenses 14, to reflect the spreading light in the direction perpendicular to the axial direction of the rod lenses 14, as shown in FIG. 8.

By installing reflecting mirrors that reflect the spreading light from the rod lenses, in this way, it is possible to regulate the length of the light irradiation region, and it is further possible to supplement the irradiance of the low-irradiance peripheral areas (ends).

In the first through third embodiments described above, it has been possible to use reflectors having multiple layers of vapor deposition with the function of allowing light in the visible and infrared regions and re-radiated heat from the lamps to pass through, while reflecting only the ultraviolet light (cold mirrors).

If cold mirrors are used as reflectors, in the event that a light irradiation device as described above is applied to an inkjet printer using light-curable inks, for example, it is possible to prevent more reliably the irradiation of the substrate by the infrared and visible light that is included in the light emitted from the discharge lamps but is not needed for curing the ink, or the thermal radiation from the arc tube of the lamps that increase in temperature when the discharge lamps are lit.

Because of this, it is possible to prevent heating of the substrate (raising the substrate to a high temperature), and consequently, it is very useful in the event that a paper, polymer, or film that is easily deformed by heat is used as the substrate.

Moreover, the short-arc type discharge lamp is not limited to an ultra-high-pressure mercury lamp; it is possible to use a metal halide short-arc type discharge lamp, for example. If a halogen compound of iron (Fe) is sealed in, in particular, the efficiency of light emission in the wavelength range of 350 to 450 nm increases, and so it is possible to increase the total discharge flux in the light irradiation area and thus to improve the efficiency of the curing process for light-curable ink, for example.

As stated above, by means of the light irradiation device of this invention, the light from a short-arc type discharge lamp that forms a point light source is reflected by a reflector 11 and is incident on rod lenses that focus the light extending in a line on the light irradiation surface, and so it is possible to improve irradiance uniformity in the lengthwise direction of linearly focused light, and to use the light from the discharge lamp more efficiently. Further, the configuration is relatively simple, and so it is possible to reduce size and weight.

Moreover, short-arc type discharge lamps have high radiance, and so the light irradiation region formed on the light irradiation surface has a uniform irradiance distribution in the lengthwise direction and is linear with an effective region, which has high peak irradiance, of the specified size. Accordingly, the light irradiation device of this invention is very useful when applied as the light source in, for example, a light-cure inkjet printer (simply called an "inkjet printer" hereafter).

Application to Inkjet Printers

The configuration when the light irradiation device of this invention is applied in an inkjet printer is explained next. Now, the explanation that follows is of an example of using the inkjet printer to print images, but it can be applied in the same way to forming patterns such as circuits.

Figure 9:
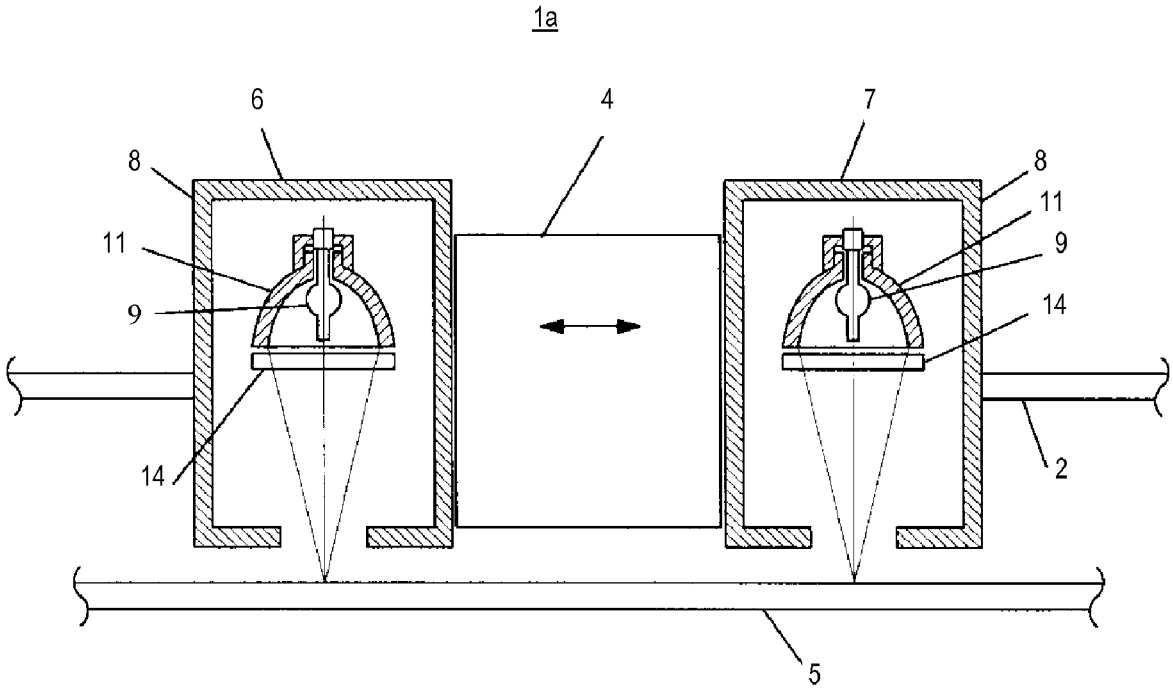
FIG. 9 is a diagram showing the configuration of an example of application of the light irradiation device of this invention in an inkjet printer.
Figure 10A:
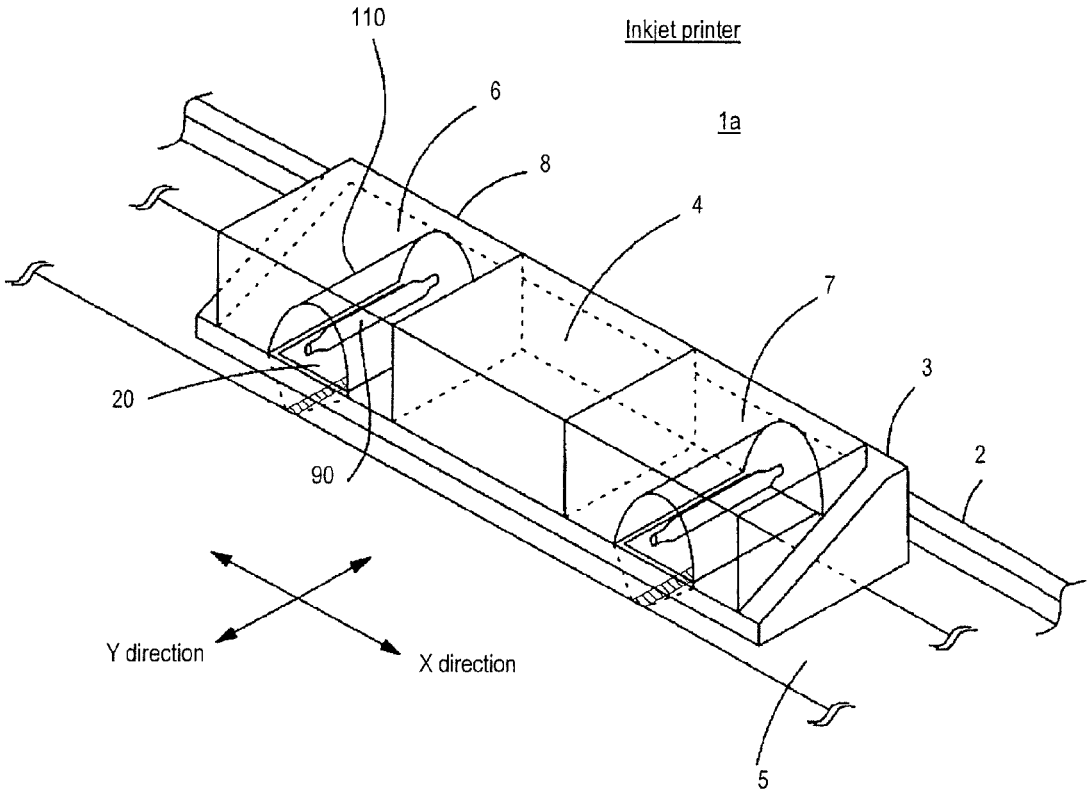
Fig. 10(a) (Prior Art)
FIGS. 10(*a*) & 10(*b*) are diagrams showing the schematic configuration of part of the head portion of a known inkjet printer.
Figure 10B:
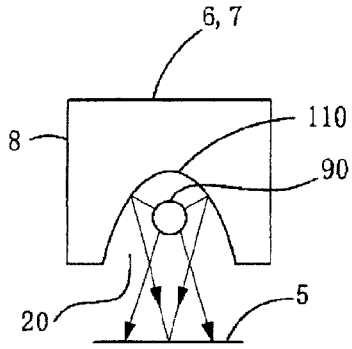
Fig. 10(b) (Prior Art)
Figure 11:
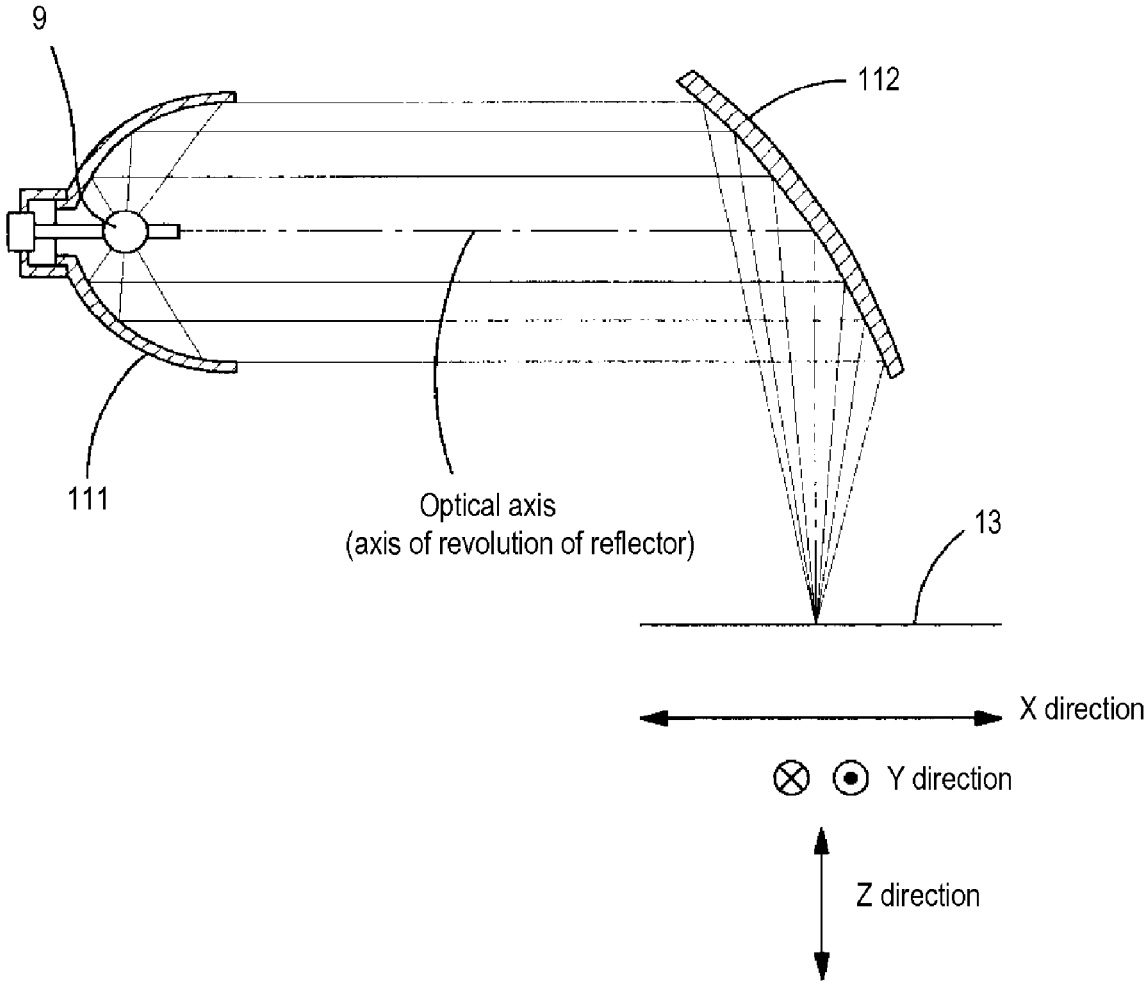
FIG. 11 is a diagram showing one example of the configuration of the light irradiation device proposed in a co-pending application.

FIG. 9 is a cross-sectional diagram that schematically shows an example of the configuration of the head portion of the inkjet printer of an embodiment of this invention. The inkjet printer of this embodiment has the same configuration as shown in FIG. 10 except for the differences in the configuration of the light irradiation devices.

This inkjet printer has a head portion 1*a* that includes an inkjet head 4 to which are attached nozzles (not shown) that eject fine droplets of light-curable inks, such as ultraviolet light-curable inks, for example, onto a substrate, and two light irradiation devices 6, 7 on the two sides of the inkjet head 4 that irradiate the ink just impacted on the substrate 5 with light of the specified wavelength region, such as ultraviolet light.

A carriage (not shown) on which the head portion 1*a* is mounted supported by a bar-shaped guide rail 2 that extends along and above the substrate 5, and it is able to move, back and forth—right and left in the figure—along the guide rail 2 above the substrate 5 by means of a drive mechanism (not shown).

Now, examples of inks that can be used as ultraviolet light-curable inks are, for example, radical polymer inks that include radical-polymerizable compounds as the polymerizable compounds and cation polymer inks that include cation-polymerizable compounds as the polymerizable compounds. Further, in the event that the inkjet printer is used for formation of patterns such as circuits, a resist ink that includes a light-polymerizable compound is used as the liquid material ejected from the inkjet head. As the substrate 5, it is possible to use paper, polymer, film, or printed circuit boards, for example.

In this embodiment, the light irradiation devices 6, 7 are constituted with the same configuration as the light irradiation device of the first embodiment (see FIG. 1).

That is, the light source 10 comprises a reflector 11 with a reflective surface that is an ellipsoid of revolution, a discharge lamp 9 that is positioned with the light emitting portion (spot of the arc, for example) at the first focal point of the reflector 11 and a straight line connecting the electrodes on the optical axis of the reflector 11, and rod lenses 14. The light source 10 is housed in a cover 8 that has an opening facing the substrate 5.

The axial direction (lengthwise direction) of the rod lenses 14 is located along the direction in which the light sources 10 are lined up, and a linear light irradiation region is formed on the substrate 5 in the direction perpendicular to the axis of the rod lenses (the direction perpendicular to the surface of the paper in FIG. 9).

The head portion 1*a* of the inkjet printer of this embodiment is located so that the substrate 5 is positioned at or near the second focal point of the reflectors of light irradiation devices 6, 7, and the position above the substrate 5 moves in accordance with the state of lighting of the discharge lamps 9. By this it is meant that the light from the discharge lamps 9 is focused in a line in the direction perpendicular to the direction of travel of the head portion (the direction perpendicular to the surface of the paper in FIG. 9) and irradiates the substrate 5, by which the ultraviolet light-curable ink is cured immediately after it impacts the substrate 5.

As a concrete explanation of the curing of ultraviolet light-curable ink, when printing is performed on the substrate 5 while the head portion 1*a* is moving to the right in FIG. 9, the ultraviolet light-curable ink that has impacted the substrate 5 is cured by light irradiated by the light irradiation device 6 that follows the movement of the head portion 1*a*. On the other hand, when printing is performed on the substrate 5 while the head portion 1*a* is moving to the left in FIG. 9, the ultraviolet light-curable ink that has impacted the substrate 5 is cured by light irradiated by the light irradiation device 7 that follows the movement of the head portion 1*a*.

By means of an inkjet printer constituted as described above, light with a high peak intensity from short-arc type discharge lamps 9 of high radiance irradiates the ultraviolet light-curable ink that has impacted the substrate 5, and so it is possible to quickly cure (polymerize) the ultraviolet light-curable ink immediately after it impacts the substrate 5, and thus it is possible to shorten the time required for curing.

It is possible, therefore, to prevent changes of dot shape, and so it is possible to form high-quality images and patterns such as circuits reliably.

Moreover, by means of a structure that irradiates the substrate 5 by reflecting light from the discharge lamps 9, by means of the light irradiation devices 6, 7 and the reflector 11, it is possible to prevent direct incidence to the substrate 5 of light from the visible and infrared regions that is not needed for curing ultraviolet-cured inks that is included in the light emitted from the discharge lamps 9 or thermal radiation from the arc tube of the discharge lamps 9 when the lamps are lit.

Consequently, it is possible to reduce slightly the effect of heat on the substrate 5, and to reliably prevent deformation of the substrate even a substrate that is easily deformed by heat is used, so that constraints on the substrates that can be used disappear.

Further, by means of this invention, the light irradiation device (lighting fixture) can constitute to be smaller and lighter than the long-arc type discharge lamp, and so the inkjet printer as a whole can be made smaller and the speed of printing and pattern formation can be increased by improving the efficiency of the ink-curing process.

Now, aside from the first embodiment, it is possible to use the variation of the first embodiment or the second or third embodiment as the light irradiation device of the inkjet printer of this invention. Furthermore, if the second embodiment is used, it is possible to obtain a longer linear irradiation region.

Moreover, the inkjet printer described above was explained in terms of a configuration in which the image record or circuit pattern is formed by moving the head portion 1*a* moves with respect to the substrate 5, but the inkjet printer of this invention can also be applied to a configuration in which the position of the head is fixed and the image or pattern is formed by intermittently conveying the substrate, for example.

Furthermore, the light irradiation device of this invention can be applied not only to light-cure inkjet printers, but also to liquid crystal or other panel laminating equipment that laminates two-ply optically transparent substrates by light irradiation of a light-curable adhesive that has been spread in a line between two optically transparent substrates. In this sort of panel laminating equipment, the length of the light irradiation region that extends in a line from the light irradiation device can be designed in response to the length of the light-curable adhesive that is spread in a line between the optically transparent substrates.

What is claimed is:

1. A light irradiation device, comprising:

a short-arc type discharge lamp which has a pair of opposed electrodes within a discharge vessel, an optical element that focuses light from the lamp, and multiple rod lenses arranged in parallel in a plane perpendicular to an optical axis of light emitted from the optical element on a light-emission side of the reflector, wherein the axial direction of the rod lenses is perpendicular to the optical axis of light emitted from the optical element.

2. A light irradiation device as described in claim 1, in which the optical element is placed so that it surrounds the discharge lamp and is a reflector with a reflecting surface that is an ellipsoid of revolution that reflects the light from the discharge lamp.

3. A light irradiation device as described in claim 1, in which the optical element is located surrounding the discharge lamp and is a reflector with a reflecting surface that is a paraboloid of revolution that reflects light emitted by the discharge lamp, and a convex lens that focuses the light from the reflector.

4. A light irradiation device as described in claim 1, comprising at least a second a short-arc type discharge lamp with a pair of opposed electrodes within a discharge vessel, a respective optical element that focuses light from the lamp, and respective multiple rod lenses arranged in parallel in a plane perpendicular to an optical axis of light emitted from the respective optical element; wherein at least a part of the regions irradiated with light emitted from adjoining optical elements overlapping in a direction perpendicular to a direction in which the regions are lined up.

5. A light irradiation device as described in claim 1, further comprising a reflecting mirror on a light emission side of the rod lenses that reflects light that spreads in a direction perpendicular to an axial direction of the rod lenses.

6. An inkjet printer having a head portion in which there is an inkjet head that ejects a light-curable liquid material onto a substrate and at least one light irradiation device that irradiates light to cure the liquid material that is ejected onto and impacts the substrate, the head portion being movable relative to the substrate and irradiating the liquid material that has impacted the substrate with light from the light irradiation device, in which the light irradiation device, comprising:

a short-arc type discharge lamp which has a pair of opposed electrodes within a discharge vessel, an optical element that focuses light from the lamp, and multiple rod lenses arranged in parallel in a plane perpendicular to an optical axis of light emitted from the optical element on a light-emission side of the reflector, wherein the axial direction of the rod lenses is perpendicular to the optical axis of light emitted from the optical element.

7. An inkjet printer as described in claim 6, in which the optical element is placed so that it surrounds the discharge lamp and is a reflector with a reflecting surface that is an ellipsoid of revolution that reflects the light from the discharge lamp.

8. An inkjet printer as described in claim 6, in which the optical element is located surrounding the discharge lamp and is a reflector with a reflecting surface that is a paraboloid of revolution that reflects light emitted by the discharge lamp, and a convex lens that focuses the light from the reflector.

9. An inkjet printer as described in claim 6, comprising at least a second a short-arc type discharge lamp with a pair of opposed electrodes within a discharge vessel, a respective optical element that focuses light from the lamp, and respective multiple rod lenses arranged in parallel in a plane perpendicular to an optical axis of light emitted from the respective optical element; wherein at least a part of the regions irradiated with light emitted from adjoining optical elements overlapping in a direction perpendicular to a direction in which the regions are lined up.

* * * * *